US005301478A

United States Patent [19]

Maese, Jr.

[11] Patent Number: 5,301,478

[45] Date of Patent: Apr. 12, 1994

[54] CHILD'S PLAYHOUSE

[76] Inventor: Maximiliano Maese, Jr., 480 Mt. Arbor St., McFarland, Calif. 93250

[21] Appl. No.: 8,148

[22] Filed: Jan. 25, 1993

[51] Int. Cl.[5] ..... E04B 1/344; E04B 7/16

[52] U.S. Cl. ..... 52/066; 52/70; 446/478

[58] Field of Search ..... 446/478, 476, 901; 52/66, 68, 70, DIG. 13, 71

[56] References Cited

U.S. PATENT DOCUMENTS 2,872,753 2/1959 Fenton ..... 446/478
4,992,068 2/1991 Conrad ..... 446/478 X
5,069,623 12/1991 Peat ..... 446/476 X
5,106,142 4/1992 Hegedus ..... 52/66 X

FOREIGN PATENT DOCUMENTS 572015 5/1924 France ..... 446/478

*Primary Examiner*—Mickey Yu
*Attorney, Agent, or Firm*—Leon Gilden

[57] ABSTRACT

A child's playhouse includes interfolded panels arranged for ease of assembly relative to one another, including hinged interconnection, wherein the top wall includes a pop-up plate having an accordion pleated member extending between the pop-up plate and the top wall to provide for ease of projection of a structure relative to the top wall.

4 Claims, 4 Drawing Sheets

CHILD'S PLAYHOUSE

BACKGROUND OF THE INVENTION

1. Field of the Invention

The field of invention relates to child playhouse structure, and more particularly pertains to a new and improved child's playhouse wherein the same is arranged for ease of construction and interfolding during periods of non-use.

2. Description of the Prior Art

Child's playhouse structure of various types are utilized throughout the prior art and exemplified by U.S. Pat. Nos. 4,964,249; 4,190,978; and 4,112,635.

The instant invention attempts to overcome deficiencies of the prior art by providing for a playhouse structure including adornments and accessories arranged for ease of projection relative to the playhouse structure and in this respect, the present invention substantially fulfills this need.

SUMMARY OF THE INVENTION

In view of the foregoing disadvantages inherent in the known types of playhouse structure now present in the prior art, the present invention provides a child's playhouse wherein the same is arranged for panels arranged for ease of assembly relative to one another. As such, the general purpose of the present invention, which will be described subsequently in greater detail, is to provide a new and improved child's playhouse which has all the advantages of the prior art playhouse structure and none of the disadvantages.

To attain this, the present invention provides a child's playhouse including interfolded panels arranged for ease of assembly relative to one another, including hinged interconnection, wherein the top wall includes a pop-up plate having an accordion pleated member extending between the pop-up plate and the top wall to provide for ease of projection of a structure relative to the top wall.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved child's playhouse which has all the advantages of the prior art playhouse structure and none of the disadvantages.

It is another object of the present invention to provide a new and improved child's playhouse which may be easily and efficiently manufactured and marketed.

It is a further object of the present invention to provide a new and improved child's playhouse which is of a durable and reliable construction.

An even further object of the present invention is to provide a new and improved child's playhouse which is susceptible of a low cost of manufacture with regard to both materials and labor, and which accordingly is then susceptible of low prices of sale to the consuming public, thereby making such child's playhouse economically available to the buying public.

Still yet another object of the present invention is to provide a new and improved child's playhouse which provides in the apparatuses and methods of the prior art some of the advantages thereof, while simultaneously overcoming some of the disadvantages normally associated therewith.

These together with other objects of the invention, along with the various features of novelty which characterized the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
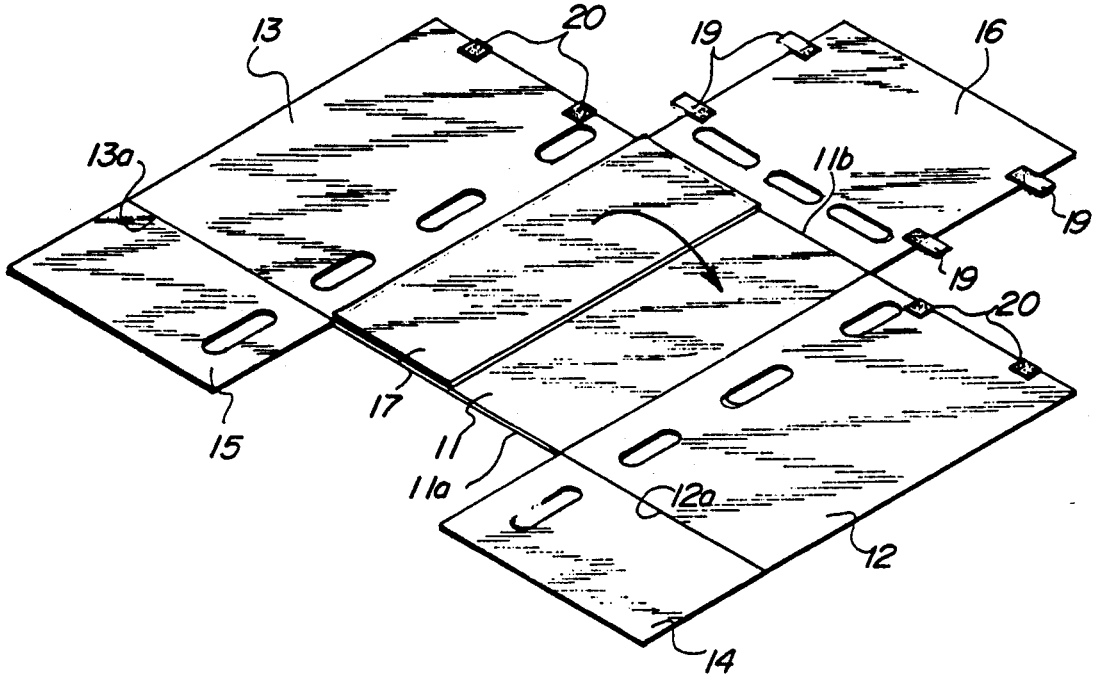
FIG. 1 is an isometric illustration of the invention in a collapsed configuration.
Figure 2:
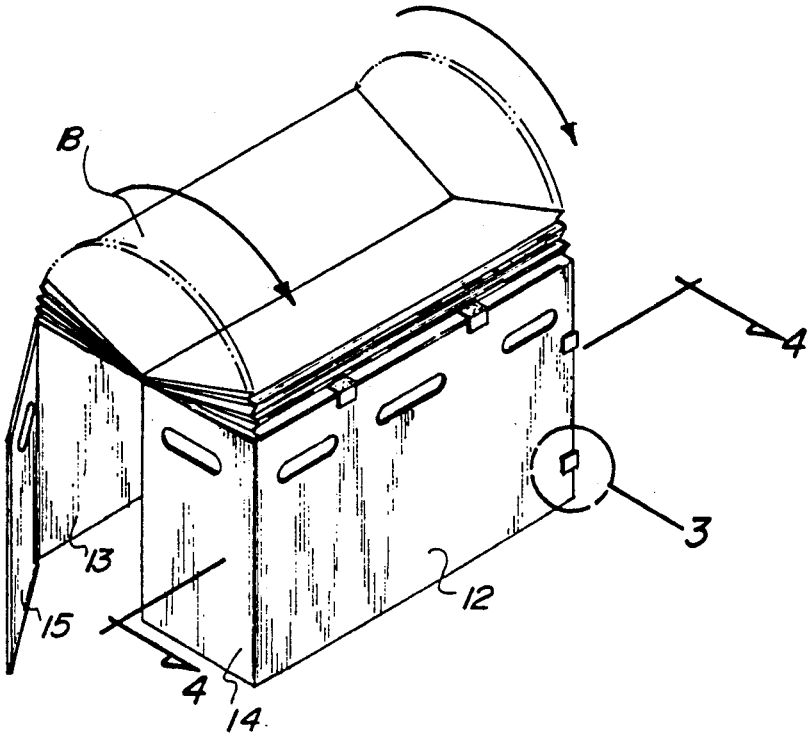
FIG. 2 is an isometric illustration of the invention in an assembled configuration.

With reference now to the drawings, and in particular to FIGS. 1 to 8 thereof, a new and improved child's playhouse embodying the principles and concepts of the present invention and generally designated by the reference numeral 10 will be described.

More specifically, the child's playhouse 10 of the instant invention essentially comprises a top wall panel 11, with a first side wall 12 hingedly mounted to the first top wall panel at a first side of the top wall panel, with a second side of the top wall panel having a second side wall 13 hingedly mounted thereto. The first and second side walls 12 and 13 are of identical geometric configuration. First door plate 14 is hingedly mounted to a first side wall first end 12*a*, with a second door plate 15 hingedly mounted to a second side wall first end 13*a* adjacent the top wall first end 11*a*, as illustrated. An end wall 16 is hingedly mounted to a top wall at a second end 11*b* of the top wall. A pop-up plate 17 is hingedly mounted medially and coextensively between the top wall first and second ends 11*a* and 11*b* orthogonally oriented relative to the first ends 11*a* and 11*b*, with an accordion pleated pop-up member 18 extending and fixedly mounted to the pop-up plate 17 and to the top wall between the hinged interconnection of the accordion pleated pop-up member 18 and the second side of the top wall panel 11*a*. In this manner, pivoting of the pop-up plate 17 about its hinged interconnection with the top wall panel 11 effects selective compaction of the pop-up member 18, as illustrated in FIG. 1, to projection of the pop-up member 18 relative to the top wall panel 11.

Figure 3:
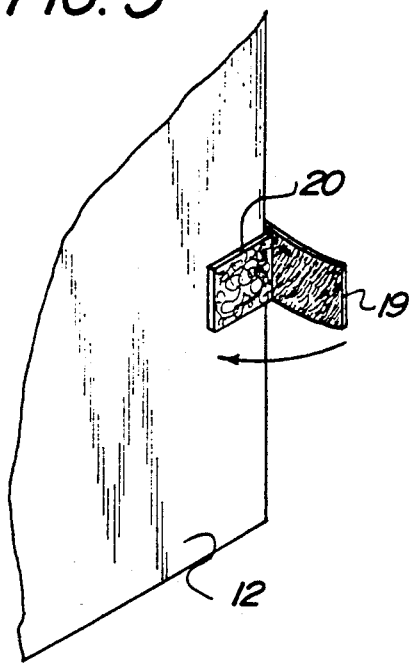
FIG. 3 is an isometric illustration of section 3 as set forth in FIG. 2.

Strap fasteners 19 are mounted to each side of the end wall 16 for securement to strap fastener securement patches 20 secured to the first and second side walls 12 and 13, as illustrated in FIG. 3 for example. Typically, hook and loop fastener structure is mounted to the strap fasteners 19 and the securement patches 20 for their interconnection.

Figure 4:
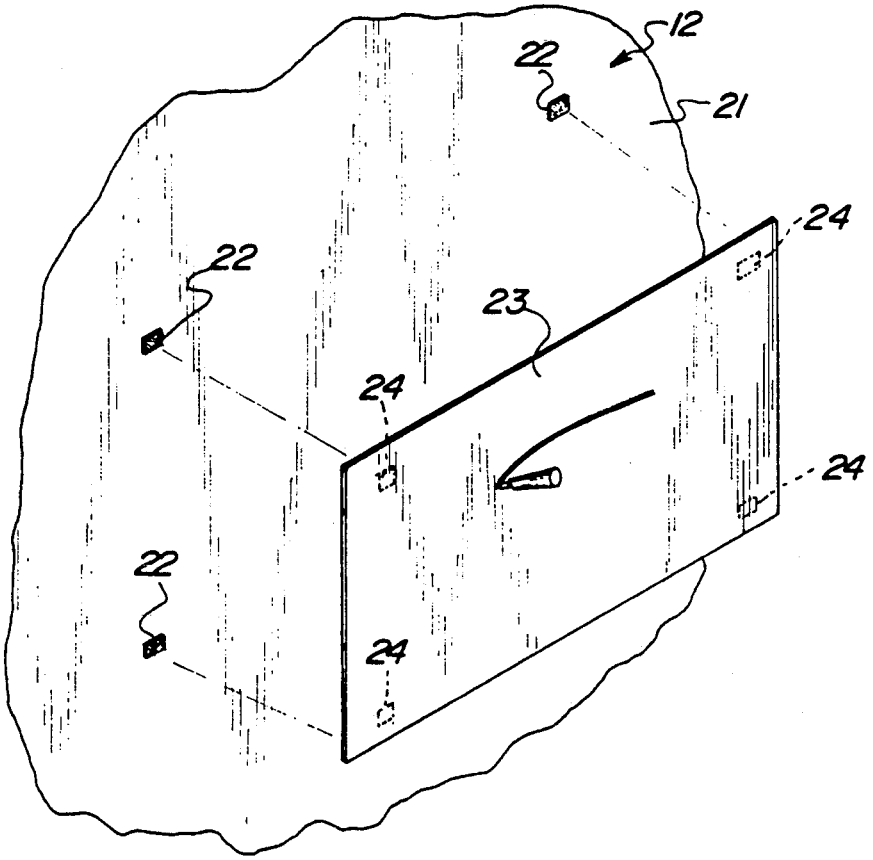
FIG. 4 is an orthographic view, taken along the lines 4—4 of FIG. 2 in the direction indicated by the arrows.
Figure 5:
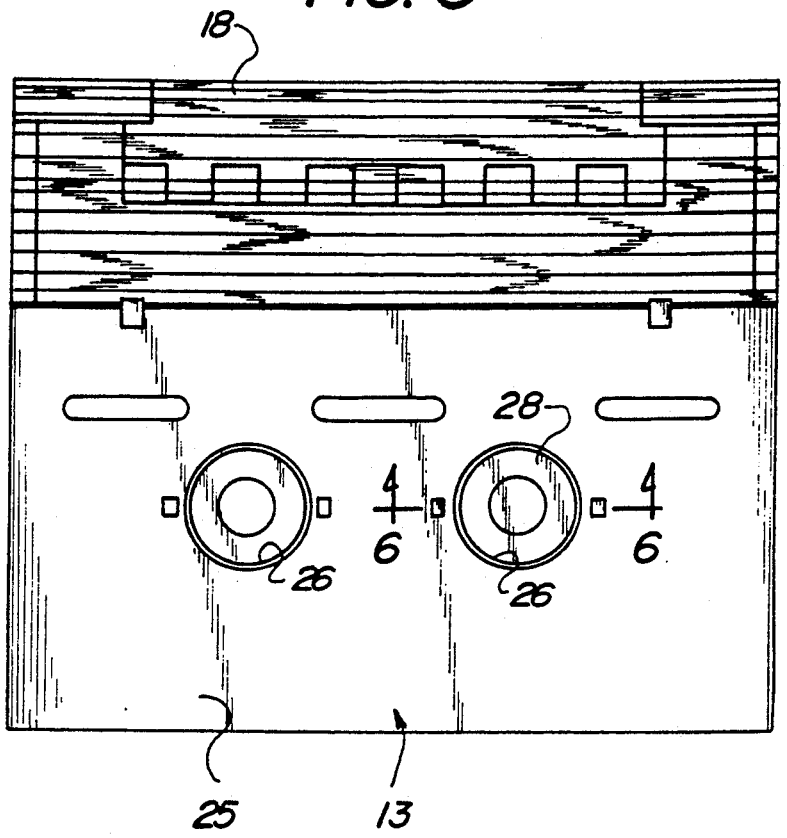
FIG. 5 is an orthographic view of the playhouse exterior surface.
Figure 6:
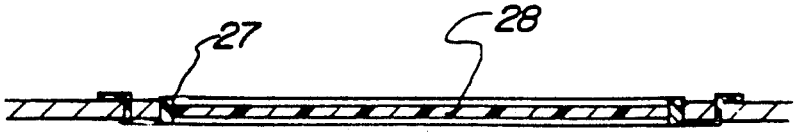
FIG. 6 is an orthographic view, taken along the lines 6—6 of FIG. 5 in the direction indicated by the arrows.
Figure 7:
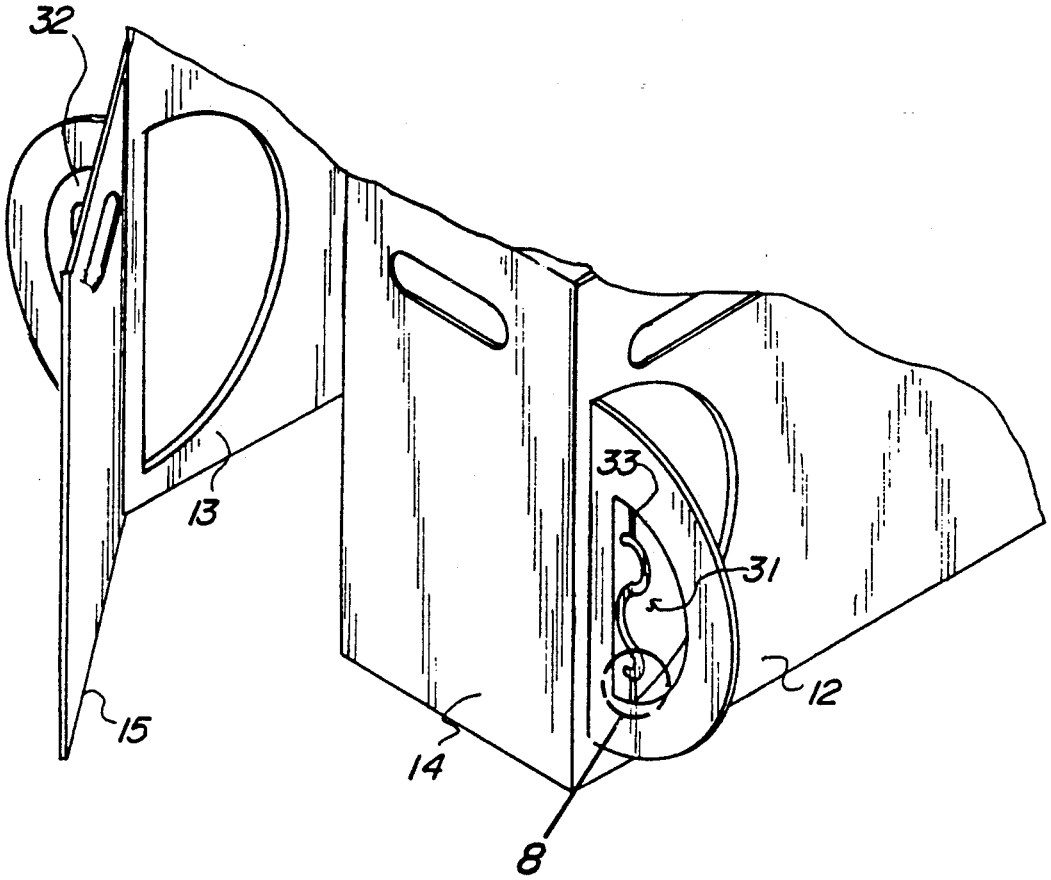
FIG. 7 is an isometric illustration of modified first and second side walls having pop-out members hingedly mounted thereto.
Figure 8:
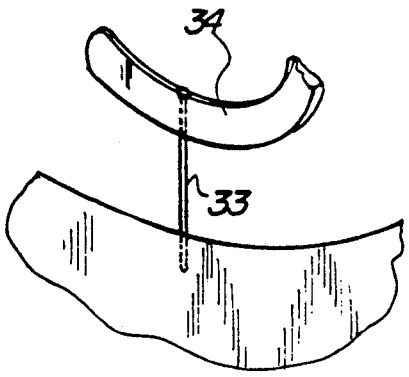
FIG. 8 is an enlarged isometric illustration of section 8 as set forth in FIG. 7.

The FIG. 4 indicates a first side wall interior surface 21, having interior surface hook and loop fastener patches 22 selectively mounting an erasable board 23 to the interior surface 21 utilizing erasable board hook and loop fastener patches 24 mounted to the erasable board 23 for its mounting to the interior surface of the hook and loop fastener patches 22.

A second side wall exterior surface 25 includes a plurality of side wall openings 26 mounting each a rigid annular frame 27 within each opening 26, wherein a target plate 28 is slidably mounted within each frame 27, whereupon striking of the target plate 28 with a tennis ball and the like displaces each target plate 28 to indicate its being struck for the amusement of children and the like utilizing the playhouse structure.

First and second D-shaped members 31 and 32 respectively are pivotally mounted within the respective first and second side walls 12 and 13, with each of the D-shaped members 31 and 32 having respective first and second openings 31 and 32, with each respective first and second opening each having a spinner axle 33, with each spinner axle including a spinner plate 34 rotatably mounted about each spinner axle for utilizing the spinner panels as wind rotatably mounted plates 34 or alternatively as spinner plates to be struck and rotated for the amusement of children and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A child's playhouse, comprising, a top wall panel, the top wall panel having a first side spaced from and parallel a second side, with a first side wall hingedly mounted to the first side, a second side wall hingedly mounted to the second side, and the top wall panel including a first end spaced from and parallel a second end. and a first door plate hingedly mounted to the first side wall at a first side wall first end, and a second door plate hingedly mounted to the second side wall at a second side wall second end, with the first door plate and the second door plate positioned adjacent the top wall first end, and an end wall, the end wall hingedly mounted to the top wall second end, and a plurality of strap fasteners mounted to the end wall, and a plurality of securement patches mounted to the first side wall and to the second side wall for securement to the strap fasteners of the end wall, and including a pop-up plate hingedly mounted medially of the top wall panel extending coextensively between the top wall first end and the top wall second end, with the pop-up plate orthogonally oriented relative to the top wall first end and the top wall second end, and an accordion pleated pop-up member mounted to the pop-up plate and to the top wall panel between the pop-up plate and the top wall second side, wherein pivoting of the pop-up plate from a first position permits the pop-up plate to extend from the top wall panel to the top wall panel second side to a second position where the pop-up plate is rotated one hundred eighty degrees extending from the top wall panel to the top wall panel first side effecting projection of the accordion pleated pop-up member beyond the top wall panel and the pop-up plate.

2. A playhouse as set forth in claim 1 wherein the first side wall includes a first side wall interior surface, and the first side wall interior surface includes a plurality of interior surface fastener patches, and an erasable board, the erasable board includes a plurality of erasable board fastener patches securable to the interior surface fastener patches to mount the erasable board relative to the first side wall interior surface.

3. A playhouse as set forth in claim 2 wherein the second side wall includes a second side wall exterior surface, and the second side wall exterior surface having a plurality of openings, wherein each of the openings includes a rigid annular frame, and each annular frame slidably receives a target plate permitting displacement of each target plate upon impact of the target plate with a projectile.

4. A playhouse as set forth in claim 3 including at least one pivot member mounted to the first side wall hingedly mounted to the first side wall having a central opening, with the central opening including a spinner axle directed within the central opening, and a spinner plate rotatably mounted about the spinner axle.

* * * * *